United States Patent [19]

Williams

[11] 4,354,884

[45] Oct. 19, 1982

[54] PROCESS FOR PREPARING PROGRESSIVE BURNING PROPELLANT GRANULES

[75] Inventor: Rafelix A. Williams, Radford, Va.

[73] Assignee: Hercules Incorporated, Wilmington, Del.

[21] Appl. No.: 144,143

[22] Filed: Apr. 28, 1980

[51] Int. Cl.[3] ..... C06B 45/28

[52] U.S. Cl. ..... 149/10; 102/290; 149/11; 149/109.6; 264/3 B; 264/3 C

[58] Field of Search ..... 149/10, 11, 109.6; 102/290; 264/3 B, 3 C

[56] References Cited

U.S. PATENT DOCUMENTS

| | | | |
|---|---|---|---|
| 2,337,943 | 12/1943 | Silk | 52/20 |
| 2,992,911 | 7/1961 | Whitworth | 52/13 |
| 3,743,554 | 7/1973 | Mellow | 149/10 |
| 3,776,787 | 12/1973 | Wood | 264/3 B |
| 3,798,085 | 3/1974 | Mellow | 149/11 |

*Primary Examiner*—Paul R. Michl

*Attorney, Agent, or Firm*—Michael B. Keehan

[57] ABSTRACT

Progressive burning propellant granules are prepared by a process in which the solvent-wet propellant granules are wetted with a mixture of burning rate deterrent and solvent. The burning rate deterrent penetrates the solvent-wet granules. After deterrent coating, the granules are dried to remove processing solvents initially present in the granules.

4 Claims, 1 Drawing Figure

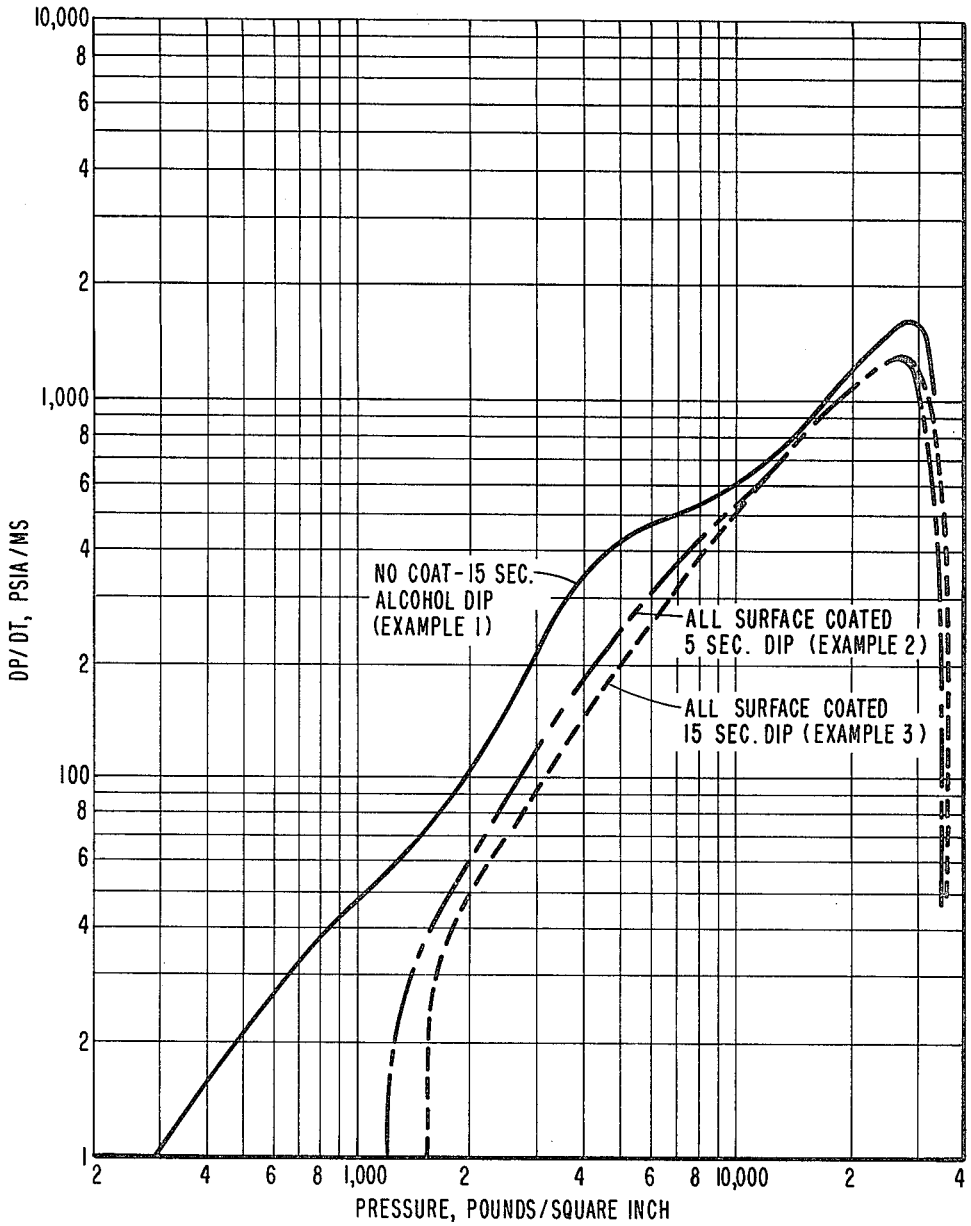
10,000
8
6
4
2
1,000
8
6
4
2
100
8
6
4
2
1
DP/DT, PSIA/MS
2
4
6
8
1,000
2
4
6
8
10,000
2
4
PRESSURE, POUNDS/SQUARE INCH
NO COAT-15 SEC. ALCOHOL DIP (EXAMPLE 1)
ALL SURFACE COATED 5 SEC. DIP (EXAMPLE 2)
ALL SURFACE COATED 15 SEC. DIP (EXAMPLE 3)

PROCESS FOR PREPARING PROGRESSIVE BURNING PROPELLANT GRANULES

This invention relates to a process for coating of solvent-wet propellant granules with burning rate deterrents for the purpose of preparing progressive burning rate propellant powder suitable for use as the propellant charge for ammunition.

PRIOR ART AND BACKGROUND

Progressive burning propellants suitable for use as the propellant powder for selected ammunition are generally prepared by adding an organic material, which is a gelatinizing agent for the nitrocellulose component of the propellant, to the propellant granules and tumbling said mixture in a rotating barrel which is heated above the melting point of the added organic material. The organic material becomes fluid upon heating and coats the powder. During the coating operation the mixture is usually wet with water. Water may be added directly to the rotating barrel or may be supplied in the form of condensed steam during heat-up of the organic coating material. This coating technique is satisfactory for use with propellants which are of the single base or double base type, i.e., propellants consisting essentially of nitrocellulose and an explosive plasticizer such as nitroglycerin. This coating technique is not satisfactory for use with propellant powder which contains in addition to nitrocellulose and explosive plasticizer, water-soluble components, e.g., nitroguanidine, or other water-soluble materials. When propellants containing nitroguanidine are coated in the presence of water or organic liquids water-soluble components such as nitroguanidine are leached out of the propellant composition and the burning characteristics of the propellant powder are adversely affected.

U.S. Pat. No. 2,992,911 discloses a process for coating the surface of nitroguanidine containing propellant powder for the purpose of preparing progressive burning propellant compositions. In accordance with the teachings of this patent, the surface of propellant powder comprising nitrocellulose, nitroglycerin and nitroguanidine is coated with a burning rate deterrent composition, said process comprising treating the powder surface with symmetrical diethyl diphenyl urea in a quantity sufficient to form a chemical complex in situ by interaction of the diethyl diphenyl urea with said nitroguanidine in a zone of inwardly diminishing concentration in the neighborhood of the surface only of said propellant powder. In practice, the diethyl diphenyl urea is dissolved in a nonsolvent for nitrocellulose such as ethyl alcohol and the resulting solution is sprayed on the powder in a rotating pan or barrel. The resulting surface modified propellant powder has progressive burning characteristics. The ballistic properties of such propellant powder are said to be substantially unaltered after storage at 65° C. for six months.

U.S. Pat. No. 3,743,554 discloses a method of deterrent coating of smokeless powder employing certain linear polyesters as the burning rate deterrent medium. In the process described in this patent, smokeless powder is agitated in a mixing tank in the presence of water containing approximately 2% of the polyester deterrent coating material. The deterrent coating material is added as a solution in methylene chloride solvent. After addition of the deterrent coating material to the mixing tank the resulting suspension is heated to 85°–90° C. for at least 30 minutes. At the end of the thirty minute period the coating of the smokeless powder is complete. The linear polyester burning rate deterrent materials employed in U.S. Pat. No. 3,743,554 are formed by reaction of dihydric alcohol components such as ethylene glycol, polyethylene glycol, propylene glycol, polypropylene glycol and neopentyl glycol, and the like with dibasic acid components such as adipic acid, azaleic acid, phthalic acid and sebacic acid and the like. The polyester materials have a weight average molecular weight of from about 1,500 to about 30,000 and a melting point not exceeding about 190° F.

German OLS No. 2,060,052, published Jun. 8, 1972, discloses a process for preparing progressive burning propellant powder by surface treating powder strands with desensitizing materials prior to cutting to final dimensions so that only external surfaces of strands are desensitized. In the process disclosed, solvent containing powder strands are passed vertically through compartments in which surface treatment is carried out by a spraying operation. The strands may be partially dried prior to entrance into the spraying compartments. It is also suggested that surface treatment can be conducted by drawing elongated powder strands through appropriate solutions.

SUMMARY OF THE INVENTION

In accordance with this invention a process is provided for preparation of progressive burning propellant granules of the single base, double base and triple base types from solvent-wet granules cut from propellant strands coming from the extrusion step in the propellant manufacturing process. The granules are deterrent coated prior to drying to remove processing solvents from the granules. The process comprises (a) wetting all surfaces of the solvent-wet propellant granules with a mixture of burning rate deterrent and solvent for a time sufficient to permit the burning rate deterrent to penetrate into the propellant granule, (b) promptly washing the resulting deterrent coated propellant granules with water to remove excess mixture of burning rate deterrent in solvent from the surfaces of said propellant granules, and (c) drying the resulting deterrent coated granules.

Illustrative burning rate deterrents which can be employed in the process of this invention include dimethyl diphenyl urea, diethyl diphenyl urea, ethylene dimethacrylate, lead-2-ethyl hexoate, linear polyesters, and the like, which deterrents are capable of diffusing into said propellant. The linear polyesters which can be employed have a weight average molecular weight of from about 1,500 to about 30,000, a melting point not exceeding 190° F. and being substantially nonmigrating within said propellant strand at temperatures not exceeding 150° F. Linear polyesters that can be employed are more specifically disclosed in U.S. Pat. No. 3,743,554 and such disclosure is incorporated herein by reference. The preferred linear polyester has an average molecular weight of about 6,600 and is prepared from neopentyl glycol (49.9%), adipic acid (34.9%), palmitic acid (15.0%) and stearicoleic acid (0.3%).

In the process of this invention, the solvents which can be employed with the burning rate deterrents must be nonaqueous and nonsolvents for nitrocellulose and nitroguanidine at the temperature of use and solvents or dispersants for the burning rate deterrents. The term solvent is used herein with respect to burning rate deterrents to mean solvent, partial solvent and dispersant.

Suitable solvents for use in the process of this invention are methyl alcohol, ethyl alcohol, n-propyl and isopropyl alcohol and n-butyl and isobutyl alcohols; ethyl ether can be employed as a solvent for dimethyl diphenyl urea, diethyl diphenyl urea and ethylene dimethacrylate. Ethyl ether is a suitable solvent for lead-2-ethyl hexoate. Methylene chloride is a suitable solvent for the linear polyester burning rate deterrents. The preferred solvents for use with burning rate deterrents in the process of this invention are the lower alcohols described above. The most preferred solvent for use in the process of this invention is ethyl alcohol.

In the process of this invention the propellant granules which are coated with burning rate deterrent are solvent-wet and contain from about 12% to about 40% by weight of processing solvents such as acetone-ethyl alcohol or ethyl ether-ethyl alcohol. Because the cut, solvent-wet propellant granules contain solvent there is no necessity for softening the powder granules as is required in prior art processes for deterrent coating of propellant granules.

In the process of this invention the burning rate deterrent is applied in amounts of from about 0.2% to about 4% by weight based on the weight of the propellant granules. The percentage of burning rate deterrent employed depends upon the contact time of the propellant granules with the mixture of burning rate deterrent and solvent and the concentration of the burning rate deterrent in mixture. Contact times on the order of from several seconds to a minute are generally satisfactory for mixtures of burning rate deterrent and solvent therefor containing about 33% by weight burning rate deterrent. In conducting the process of this invention the propellant granules can be wetted with the mixture of burning rate deterrent and solvent by any suitable means such as by dipping of the propellant granules into a bath containing a solution or dispersion of the burning rate deterrent. The process of this invention is designed for coating all exterior and interior surfaces of the propellant granule.

The following examples further illustrate this invention. In the examples and throughout the specification parts and percentages where used are by weight unless otherwise specified.

TABLE 1-continued

| | |
|---|---|
| Nitroguanidine | 47.7% |
| Diethyl diphenyl urea | 1.5% |
| Cryolite | 0.3% |

Processing solvents comprise about 10–12% by weight of the propellant composition. The solvent-wet propellant strand prepared by a process as described is then passed through a cutting machine to form solvent-wet granules of propellant. The solvent-wet granules of propellant are placed in two mesh baskets and each basket is dipped into a bath containing a solution of burning rate deterrent comprising one part diethyl diphenyl urea and two parts ethyl alcohol. The residence time of the granules in the burning rate deterrent solution is 5 seconds (Example 2) and 15 seconds (Example 3), respectively. The mesh baskets containing the propellant granules are then removed from the bath and immediately the granules are washed with water to remove all solvent and excess burning rate deterrent on the granule surfaces. The granules are then dried at a temperature of about 140° F. for about 24 hours to remove substantially all the processing solvents from the granules.

As a control test, propellant granules of the same composition as those described in Table 1 were dip coated in a bath containing ethyl alcohol only (Example 1). The granules are then dried and glazed. These granules containing no burning rate deterrent are compared with propellant granules of this invention (Examples 2 and 3) in partial burning tests and closed bomb ballistic tests in which the rate of change of pressure dp/dt (psi/millisecond) is measured continuously at pressures up to 35,000 psi. Results of these measurements are depicted in the FIGURE.

Results of the partial burning tests are presented in Table 2. The data in this table show that the burning rate deterrent penetrated into the propellant and is exponentially distributed in decreasing quantity from granule exterior surface toward the interior of the granule, thereby producing progressive burning propellant granules.

TABLE 2

| | Initial Granules | | Granules After 10 mils* (Burn) | | Granules After 25 mils* (Burn) | | Granules After 40 mils* (Burn) | |
|---|---|---|---|---|---|---|---|---|
| Example No. | Weight, grams | Coating, percent | Weight, grams | Coating, percent | Weight, grams | Coating, percent | Weight, grams | Coating, percent |
| 1 | 0.4439 | 0.00 | 0.4080 | 0.00 | 0.3158 | 0.00 | 0.2093 | 0.00 |
| 2 | 0.4544 | 3.33 | 0.4055 | 1.36 | 0.3249 | 0.42 | 0.2500 | 0.42 |
| 3 | 0.4511 | 3.00 | 0.3730 | 0.85 | 0.3221 | 0.54 | 0.2500 | 0.32 |

*Initial and Average Remaining Individual Grain Weights (grams) and Coating Level (percent). Burning of Granules Stopped at pre-established points by blowout of Sheared Brass Shim Stock Blowout Discs (thickness in mils). 1 Mil of Shim Stock Thickness corresponds to about 1% by weight of propellant burned.

EXAMPLES 1–3

A propellant composition was prepared by conventional double base propellant manufacturing methods employing ethyl alcohol and acetone as the processing solvents. The propellant was mixed in a sigma blade mixer, blocked in a blocking press and extruded into strands. The propellant composition (excluding processing solvents) is set forth below.

TABLE 1

| | |
|---|---|
| Nitrocellulose (12.6% N) | 28.0% |
| Nitroglycerin | 22.5% |

Closed bomb test data were measured at 90° F. and are set forth in Table 3. Triplicate samples of propellant granules of Examples 1–3 are measured at four pressures. The data can be used to show that dp/dt vs. pressure relationships are accurately described by the power equation $Y=AX^B$ where Y is pressure in pounds/square inch (psi), X is dp/dt in (psi)/milliseconds, B is the slope of log-log curves of dp/dt vs. pressure, and A is a constant dependent upon propellant granule geometry, deterrent coating and granule formulation.

TABLE 3

| Pressure psi × $10^{-3}$ | 90° F. Closed Bomb Test Data, dp/dt (psi/msec) | | | | | | | | |
|---|---|---|---|---|---|---|---|---|---|
| | Example 1 | | | Example 2 | | | Example 3 | | |
| | 1 | 2 | 3 | 1 | 2 | 3 | 1 | 2 | 3 |
| 5 | 361 | 365 | 358 | 256 | 255 | 256 | 232 | 225 | 222 |
| 10 | 638 | 644 | 636 | 523 | 520 | 530 | 490 | 486 | 479 |
| 15 | 890 | 899 | 891 | 793 | 780 | 811 | 759 | 763 | 752 |
| 20 | 1126 | 1138 | 1131 | 1067 | 1061 | 1096 | 1035 | 1049 | 1035 |

The process of this invention reduces thermal exposure of propellant by elimination of the initial drying step associated with most deterrent coating processes. Propellant granules containing processing solvent do not have to be pre-softened with solvents as is common practice, prior to deterrent coating. All surfaces of the propellant granules are deterrent coated in accordance with the process of this invention.

What I claim and desire to protect by Letters Patent is:

1. A process for preparation of progressive burning propellant granules of the single base, double base and triple base types from solvent-wet granules cut from propellant strands coming from the extrusion step in the propellant manufacturing process and prior to drying the solvent wet granules to remove processing solvents, said process comprising:

(a) wetting all surfaces of the solvent-wet propellant granules with a mixture of burning rate deterrent and solvent, said burning rate deterrent being selected from dimethyl diphenyl urea, diethyl diphenyl urea, ethylene dimethacrylate, lead-2-ethyl hexoate and linear polyesters capable of diffusing into said propellant granule, said polyesters having a weight average molecular weight of from about 1,500 to about 30,000, melting point not exceeding 190° F. and being substantially nonmigrating within said propellant strand at temperatures below 150° F., and continuing wetting for a time sufficient to permit the burning rate deterrent to penetrate into the propellant granule, (b) promptly washing the resulting deterrent coated propellant granules with water to remove excess mixture of burning rate deterrent and solvent from the surfaces of said propellant granules, and (c) drying the resulting deterrent coated granules.

2. The process of claim 1 in which the solvent is selected from methyl alcohol, ethyl alcohol, n-propyl alcohol, isopropyl alcohol, n-butyl alcohol, isobutyl alcohol and ethyl ether.

3. The process of claim 1 in which the solvent is ethyl alcohol and the burning rate deterrent is a linear polyester having a weight average molecular weight of from about 1,500 to about 30,000 and a melting point not exceeding 150° F.

4. The process of claim 3 in which the linear polyester is prepared by reaction of a mixture comprising neopentyl glycol, adipic acid and palmitic acid.

* * * * *